US005242139A

United States Patent [19]

Aldrich

[11] Patent Number: 5,242,139

[45] Date of Patent: Sep. 7, 1993

[54] KEYBOARD SUPPORT

[76] Inventor: Steven H. Aldrich, 5171 N. Five Mile Rd., Hope, Mich. 48628

[21] Appl. No.: 846,031

[22] Filed: Mar. 5, 1992

[51] Int. Cl.[5] ..... B43L 15/00

[52] U.S. Cl. ..... 248/118; 248/118.1; 248/918; 400/715

[58] Field of Search ..... 248/918, 118, 118.1, 248/118.3, 118.5; 400/715

[56] References Cited

U.S. PATENT DOCUMENTS

| | | | |
|---|---|---|---|
| 3,062,609 | 11/1991 | Hames et al. | 248/918 X |
| 4,481,556 | 11/1984 | Berke et al. | 248/118 X |
| 4,483,572 | 11/1984 | Story | 248/918 X |
| 4,913,390 | 4/1990 | Berke | 248/176 |
| 4,973,176 | 11/1990 | Dietrich | 400/715 |
| 4,976,407 | 12/1990 | Schwartz | 400/715 X |
| 5,042,761 | 8/1991 | McBride et al. | 248/918 X |
| 5,048,784 | 9/1991 | Schwartz et al. | 400/715 X |
| 5,056,743 | 10/1991 | Zwar et al. | 400/715 X |

OTHER PUBLICATIONS

"Adjustable Terminal Table" IBM Technical Disclosure Bulletin, vol. 28, No. 2, Jul. 1985, pp. 747-750.

*Primary Examiner*—David L. Talbott

*Attorney, Agent, or Firm*—Gifford, Groh, Sprinkle, Patmore and Anderson

[57] ABSTRACT

A support for use with a keyboard for supporting the wrists of an operator. The support includes a base having a front, sides, and a back. The base is contoured to receive and support a keyboard. A pad member is secured to an upper surface of the base along the entire front. The pad member provides cushioning support for the wrists of the operator. An enclosure is also provided and includes a mounting platform which is slidably mounted along a lower surface thereof. The keyboard and support are placeable upon the mounting platform so as to be withdrawn from the enclosure. A computer terminal may be appropriately placed atop the enclosure so as to be optimally positioned with respect to the keyboard operator.

3 Claims, 1 Drawing Sheet

KEYBOARD SUPPORT

BACKGROUND OF THE INVENTION

I. Field of the Invention

The present invention relates to a support, and more particularly, to a computer keyboard support for supporting the wrists and forearms of the keyboard's operator.

II. Description of the Prior Art

Various supports are known in the art for supporting and protecting the wrists and forearms of keyboard operators. The purpose of the support is to minimize the unsupported wrist and arm movements of the operator which contribute to fatigue and possible physical injury. A common condition arising from such movements is Carpal Tunnel Syndrome.

U.S. Pat. No. 5,004,196 issued to Gross discloses a pad support for each wrist of a keyboard operator. The pads are adjustable vertically, transversely, and pivotably relative to the keyboard so as to minimize the unsupported wrists and arm movements of the operator. Gross, however, does not provide a pad support extending the entire width of the keyboard for supporting the wrists and forearms of the keyboard operator, nor does it provide a supporting structure for optimal angular positioning of the keyboard with respect to the pad support.

SUMMARY OF THE PRESENT INVENTION

The present invention provides a support for use with a keyboard for supporting the wrists of an operator.

The support includes a base having a front, a top, and a back. The base has a generally "Z"-shaped configuration and provides a downwardly angled edge along the front and an upwardly angled edge along the back. The oppositely directed edges cause the top portion of the base to be sloped downwardly from the front towards the back. The contours of the support permit the keyboard to be placed such that its rows of keys are arranged along a horizontal plane to provide easier access to the keyboard operator.

A pad is secured to an upper surface of the base and extends along the entirety of the front. The pad extends a predetermined distance above the horizontal plane of the keys and provides comfortable cushioned support for the wrists of the operator. The horizontal arrangement of the keys of the keyboard in combination with the elevated support provided by the pad further reduces stress on the operator's wrists and forearms.

An enclosure may be provided for the keyboard support. The enclosure includes a platform slidably receivable within the enclosure. The keyboard support is placeable upon the platform such that it may be slidably withdrawn from within the enclosure and returned therein for storage. A computer terminal may conveniently be set atop the enclosure so as to be accessible to the operator when using the keyboard.

BRIEF DESCRIPTION OF THE DRAWING

A better understanding of the present invention will be had upon reference to the following detailed description, when read in conjunction with the accompanying drawings, wherein like reference characters refer to like parts throughout the several views, and in which.

DETAILED DESCRIPTION OF A PREFERRED EMBODIMENT OF THE PRESENT INVENTION

Figure 1:
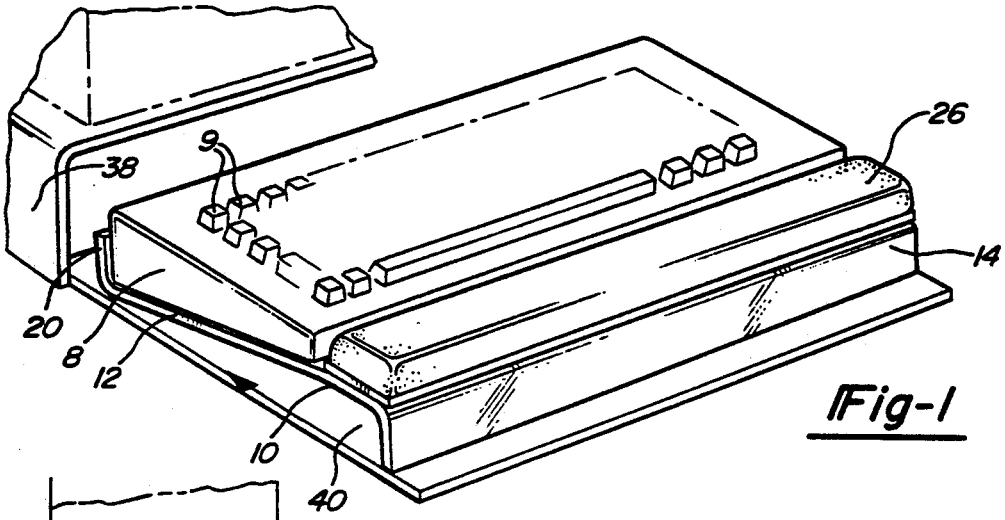
FIG. 1 a perspective view of the keyboard support of the present invention.
Figure 2:
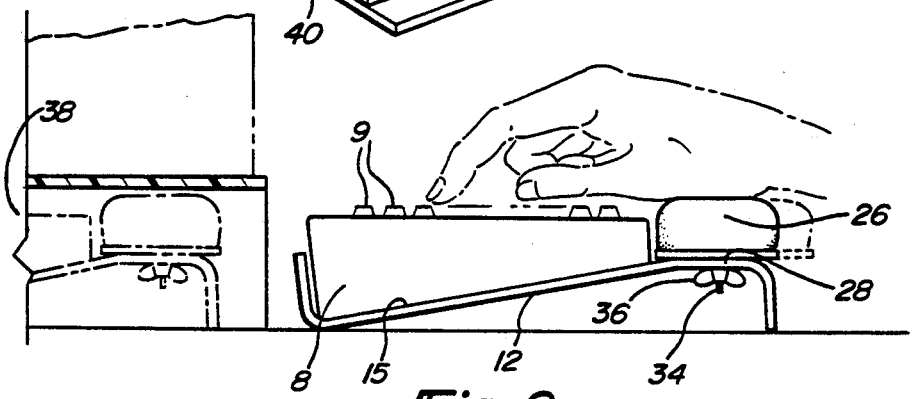
FIG. 2 is a side view of the keyboard support and showing an enclosure into which it may be slidably inserted.
Figure 3:
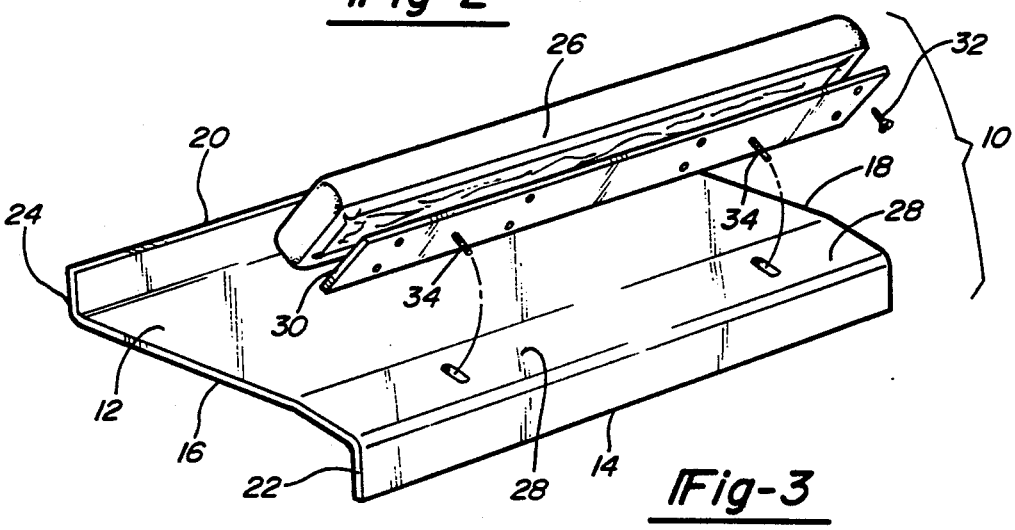
FIG. 3 is an exploded view of the connections between the pad member and the base of the keyboard support of the present invention.

With reference to FIGS. 1 through 3, a support 10 for use with a keyboard 8 is shown and includes a base 12. The base 12 has generally a "Z"-shape consisting of a front 14, sides 16 and 18, and a back 20. A downwardly angled edge 22 forms the front 14 of the base 12. An upwardly angled edge 24 forms the back 20 of the base 12. The top surface 15 of the base 12 is, accordingly, downwardly sloped from the front 14 to the back 20. The angle of the inclined top surface 15 of the base 12 is selected so that the rows of keys 9 of the keyboard 8 are substantially horizontal when the keyboard 8 is placed thereon, as shown in FIG. 2. The base 12 is constructed of a structural plastic or like material, and is preferably transparent.

A pad 26 secures to a generally horizontal portion 28 of the top surface 15 adjacent to the front 14 of the base 12. The pad 26 preferably extends along the entirety of the front 14 of the support 10. The pad 26 is constructed of a foam or suitable cushioning material. The exterior of the pad 26 is covered with a vinyl or other suitable material which enables the pad 26 to provide a durable yet comfortable cushioning to the wrists and lower arms of the operator. The pad 26 is preferably mounted to a rigid plate 30 by screws 32 or any other suitable method. In turn, the rigid plate 30 is secured to the top surface 28 of the base 12 adjacent the front 14 by any means known in the art, such as screws 34 and wing nuts 36, as shown in FIG. 2.

Referring again to FIGS. 1 and 2, an enclosure 38 is provided for housing the support 10. The enclosure 38 may include a platform 40 which is slidably mounted so that it may be withdrawn from the inside of the enclosure 38. The support 10 and keyboard 8 may be placed atop the platform 40 so that the keyboard may be slidably withdrawn from the enclosure 38 for access by the operator and returned to the enclosure 38 when not being used. A computer terminal may be set atop the enclosure 38, so as to be optimally positioned with respect to the keyboard 8 and the keyboard operator.

Having described my invention, many modifications thereto will become apparent to those skilled in the art to which it pertains without deviation from the spirit of the invention as defined by the scope of the appended claims.

I claim:

1. A support for use with a keyboard, said keyboard having a top surface and a bottom surface which are angled with respect to each other, said support supporting the wrists and forearms of a keyboard operator, said support comprising:

a base having a front flange, a top, and a back, said flange being generally vertically aligned and said back being angled upwardly, said top having a first horizontal portion adjacent said front, said top further having a second downwardly-inclined portion angled complementary to the angle of said keyboard bottom surface with respect to said keyboard top surface so that said keyboard is supported such that the keys are disposed along a horizontal plane, said second downwardly-inclined portion extending from said first horizontal portion to said back of said base; and a pad secured to said first horizontal portion of said top and extending along said front to provide cushioning support for the wrists and forearms of the operator of the keyboard.

2. The support as described in claim 1, further comprising means for slidably mounting said support and said keyboard beneath a computer terminal.

3. The support as described in claim 2 wherein said means for slidably mounting includes an enclosure and a platform slidably mounted within said enclosure, said platform capable of being withdrawn from said enclosure to provide access to said keyboard.

* * * * *